US006935800B2

(12) United States Patent
Hetzel

(10) Patent No.: US 6,935,800 B2
(45) Date of Patent: Aug. 30, 2005

(54) MARKING INSTRUMENT AND COSMETIC PENCIL

(75) Inventor: Marvin J. Hetzel, Lewisburg, TN (US)

(73) Assignee: Cosmolab, Inc., Lewisburg, TN (US)

( * ) Notice: Subject to any disclaimer, the term of this patent is extended or adjusted under 35 U.S.C. 154(b) by 230 days.

(21) Appl. No.: 10/267,724

(22) Filed: Oct. 9, 2002

(65) Prior Publication Data

US 2004/0071491 A1 Apr. 15, 2004

(51) Int. Cl.[7] ..... B43K 19/14; A45D 40/20
(52) U.S. Cl. ..... 401/96; 401/49
(58) Field of Search ..... 401/49, 50, 96

(56) References Cited

U.S. PATENT DOCUMENTS

| | | | | |
|---|---|---|---|---|
| 2,124,611 A | | 7/1938 | Dreyfus | 106/169.56 |
| 3,704,071 A | * | 11/1972 | Muller et al. | 401/96 |
| 5,360,281 A | * | 11/1994 | Kamen et al. | 401/96 |
| 5,984,556 A | * | 11/1999 | Gray et al. | 401/96 X |
| 6,409,402 B2 | | 6/2002 | Tani et al. | 401/96 |
| 2004/0052827 A1 | | 3/2004 | Winkler et al. | 424/401 |

FOREIGN PATENT DOCUMENTS

| | | |
|---|---|---|
| CH | 241 676 | 9/1946 |
| WO | WO 02/26903 | 4/2002 |

OTHER PUBLICATIONS

Written Opinion dated Jun. 25, 2004 from the European Patent Office (IPEA) in International Application No. PCT/US03/31278.

Kirk–Othmer, Encyclopedia of Chemical Technology, 5$^{th}$ Edition, John Wiley and Sons; "Cellulose Esters"; pp. 496–540 (1993).

TENITE™ Product Information; (Product Name Tenite cellulosic plastics); Publication PPC–100D; Eastman Chemical Company (1999).

Material Safety Data Sheet for "Tenite" Propionate 384A4000016; prepared by Eastman Product Safety and Stewardship, Eastman Chemical Company, Kingsport, TN 37662 (Jul. 12, 1999).

Product Data Sheet for Tenite Propionate 384A4000016 Clear, Trsp; http://www.eastman.com/ProductCatSQ/tech-datasheet.asp?productid=1279&familyGMN=71004485; printed Dec. 20, 1999.

Tenite™ Cellulosic Plastics From Trees to Plastic; "*A Renewable Resource*" (undated); http://www.eastman.com/online_publications/ppc100d/index.html; printed Sep. 12, 2002.

Tenite™ Cellulosic Plastics From Trees to Plastic; "*From Trees to Cellulose*" (undated); http://www.eastman.com/online_publications/ppc100d/ppc100d03;htm; printed Sep 12, 2002.

Tenite™ Cellulosic Plastics From Trees to Plastic; "*From Cellulose to Ester*" (undated); http://www.eastman.com/online_publications/ppc100d/ppc100d04.htm; printed Sep. 12, 2002.

(Continued)

*Primary Examiner*—Gregory L. Huson
*Assistant Examiner*—Kathleen J. Prunner
(74) *Attorney, Agent, or Firm*—Marshall, Gerstein & Borun LLP

(57) ABSTRACT

The subject articles include a housing including a cellulose ester (for example propionic acid esters and mixed esters), optionally encasing a marking mass, such as a cosmetic mass, and methods for making the same, such as by molding such as injection molding, extruding, and fabricating (e.g., by turning and drilling).

18 Claims, 1 Drawing Sheet

OTHER PUBLICATIONS

Tenite™ Cellulosic Plastics From Trees to Plastic; "*Compounding: Custom Recipes*" (undated); http://www.eastman.com/online_publications/ppc100d/ppc100d06.htm; printed Sep. 12, 2002.

Tenite™ Cellulosic Plastics From Trees to Plastic; "*Properties*" (undated); http://www.eastman.com/online_publications/ppc100d/ppc100d09.htm; printed Sep. 12, 2002.

Tenite™ Cellulosic Plastics From Trees to Plastic; "*Chemical Resistance*" (undated); http://www.eastman.com/online_publications/ppc100d/ppc100d10.htm; printed Sep. 12, 2002.

Tenite™ Cellulosic Plastics From Trees to Plastic; "*Processing and Secondary Operations*" (undated); http://www.eastman.com/online_publication/ ppc100d /ppc 100d11.htm; printed Sep. 12, 2002.

Tenite™ Cellulosic Plastics From Trees to Plastic; "*Applications*" (undated); http://www.eastman.com/online_publications/ppc100d/ppc100d12.htm; printed Sep. 12, 2002.

Tenite™ Cellulosic Plastics From Trees to Plastic; "*Typical Uses of Tenite Cellulosics*" (undated); http://www.eastman.com/online_publications/ppc100d/ppc100d13.htm; printed Sep. 12, 2002.

Tenite Plastics™ ; "*Chemical Resistance of Tenite Propionate*"; Eastman Chemical Company (2000); http://www.eastman.com/online_publications/PP103b/index.htm; printed Sep. 12, 2002.

Tenite® plastics Product Information: (Product Name Tenite Propionate 384A400016 Clear, Trsp); Eastman Chemical Company (2002); http://www.eastman.com/Brands/Tenite/ProductHome.asp?Product=1279; printed Sep. 12, 2002.

Tenite® plastics Product Information; "List of Applications"; (Product Name Tenite Propionate 384A400016 Clear, Trsp); Eastman Chemical Company (2002); http://www.eastman.com/Brands/Tenite/listApplications.asp?pids=1279; printed Sep. 12, 2002.

"*From Trees to Plastic, Publication PPC–100D*", Eastman Chemical Company, pp. 1–13, Jul. 1999.

"*Tenite Propionate 360A4861316 Clear, Trsp Product Data Sheet*", Eastman Chemical Company, believed to have been available Feb. 6, 2001.

International Search Report of the European Patent Office in International Application No. PCT/US03/31278, mail date Feb. 12, 2004 (7 pages).

* cited by examiner

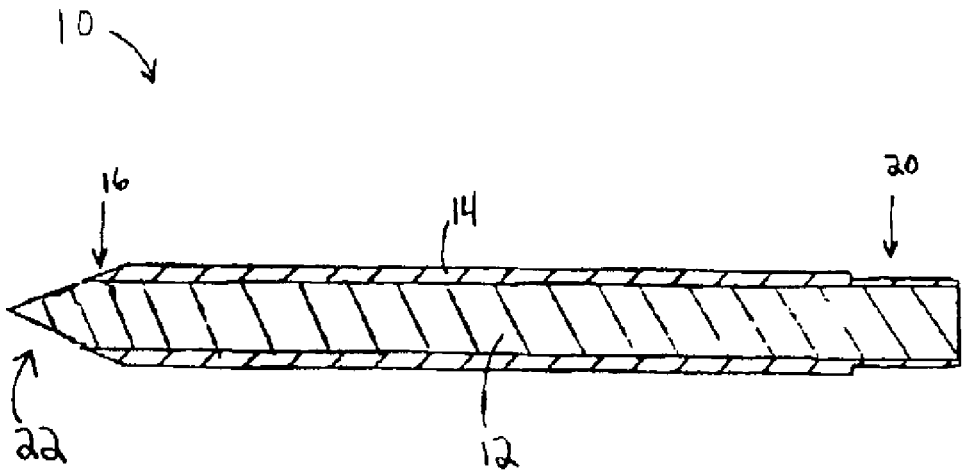
10
16
14
20
22
12

MARKING INSTRUMENT AND COSMETIC PENCIL

BACKGROUND

1. Field of the Invention

The invention generally relates to marking instruments and materials for producing marking instruments. More particularly, the invention relates to marking instrument materials that encase a marking mass.

2. Brief Description of Related Technology

Marking instruments, including cosmetic marking instruments, employ a variety of materials to hold the marking material or cosmetic mass. The container for the marking can both protect the user's hands from marking, and protect the marking material from the environment. Thus, for example, a crayon generally includes a paper wrapping, a pencil generally includes a wooden barrel, and a lipstick generally includes a synthetic resin plastic applicator or container.

In many applications, the color or shade of a marking material can be discerned only from an exposed portion (e.g., tip end) of the marking material, or is indicated by decorating the container for the material with the same (but, often, only similar) color. Thus, there is a general need for transparent or translucent containers, such that the shade of a marking material can be discerned by mere inspection of the article as a whole. In addition, conditions such as chemical compatibility between a housing material and a marking material, structural and dimensional suitability of housing materials, and forming ability of housing materials must be satisfied for particular applications. In particular, for pencils, the ability to sharpen a pencil (including the selective removal of barrel material by cutting) can be important in certain applications.

SUMMARY

One aspect of the disclosure provides a marking instrument housing including a cellulose ester, and a marking mass optionally encased in the housing.

Another aspect of the disclosure provides a method for making a marking instrument, including disposing a marking mass inside a cellulose ester housing.

Further aspects and advantages may become apparent to those skilled in the art from a review of the following detailed description, taken in conjunction with the appended claims. While the invention is susceptible of embodiments in various forms, described hereinafter are specific embodiments with the understanding that the disclosure is illustrative, and is not intended to limit the invention to the specific embodiments described herein.

BRIEF DESCRIPTION OF THE DRAWING

The sole FIGURE is a cross-sectional view of a embodiment of a marking instrument housing and a marking instrument according to the disclosure.

DETAILED DESCRIPTION

The invention generally relates to marking instrument housings, marking instruments employing the housings, and methods of making marking instruments and housings.

Marking instruments include generally stick-shaped articles such as crayons, lipsticks, lip balms, artist's chalks, graphite pencils, cosmetic pencils, markers, and shoe polishes. A pencil can generally be described as a generally elongated, cylindrical configuration of a particular diameter with a central axis and a central core of marking material surrounded by a sheath of preferably sharpenable material. Accordingly, generally any pigmented (colored, including black and white) marking material can be employed in a marking instrument, including chalky, fatty, waxy, oily, and gelled masses such as cosmetics (e.g., lip color, eye shadow, cheek color, eyebrow color). A cosmetic mass can also include or consist essentially of one or more ingredients selected from waxes, oils, polymers, siloxanes, and pigments. Preferably, the marking mass is a solid at room temperature.

One aspect of the disclosure is a marking instrument housing material that includes, or consists essentially of, one or more cellulose esters. Cellulose esters (acylated cellulose polymers) can be made by reacting cellulose (e.g., from softwood trees) with selected acids and anhydrides, and are available for purchase from a variety of sources such as Eastman Chemical Company of Kingaport, Tenn. (e.g., TENITE cellulosic plastics).

Cellulose is a long-chain polymer of anhydroglucose units. The properties of cellulose esters are affected by degree of substitution, or DS, the acyl chain length, and the degree of polymerization (DP, related to molecular weight) of the cellulose polymer. The DS can be expressed as the average number of acyl groups per anhydroglucose unit of cellulose, or by weight percent. With increasing acyl chain length, the melting point, tensile strength, mechanical strength, and density generally decrease, whereas solubilities in nonpolar solvents and resistance to moisture increase. Fewer acyl groups per anhydroglucose unit (i.e., increased hydroxyl content) increases the solubility in polar solvents and decreases moisture resistance. Accordingly, cellulose esters can be blended to provide a suitable housing material for a particular application. In addition, or in the alternative, one or more mixed esters, such as cellulose acetate propionate, can be used. In an embodiment wherein a sharpenable pencil-type instrument is desired, one or more cellulose esters is selected to provide a density and toughness suitable for sharpening.

The housing preferably is sharpenable, for example, wherein a thin portion of the housing can be selectively removed by cutting at an angle, such as with a pencil sharpener or knife. Furthermore, a marking mass loaded in a housing preferably is sharpenable. According to one test for sharpenability, the housing, loaded with a tipped marking mass, is held at 20° C. for 24 hours, then the tip of the marking mass is broken. Next, the housing and marking mass are attempted to be shaped in an appropriate sharpener (e.g., a cosmetic pencil sharpener to achieve a cone or truncated cone). The housing can be considered sharpenable if a portion of the housing can be removed without substantial crumbling and without substantial holdup of a cutting instrument (e.g., a blade in the sharpener) in the housing. Furthermore, the instrument can be considered sharpenable if the housing is sharpenable and the marking mass contained therein can be simultaneously shaped (e.g., to achieve a cone or truncated cone).

Preferred cellulose esters include esters of $C_2$–$C_6$ acids, and combinations thereof. One housing embodiment includes, or consists essentially of, one or more cellulose esters of $C_2$–$C_4$ acids (e.g., acetic, propionic, butryic, and succinic acids), and combinations thereof. Aliphatic acids and monoacids are preferred. A degree of substitution in a range of about 1 to about 3 is generally preferred. Cellulose nitrate and derivatives and cellulose xanthate and derivatives may also find utility in a housing according to the invention.

Preferred cellulose esters include mono-, di-, and tri-esters such as cellulose acetate, cellulose diacetate, cellulose triacetate, cellulose propionate, cellulose butyrate, cellulose acetate propionate, cellulose acetate butyrate, cellulose propionate butyrate, and combinations thereof.

Cellulose acetate propionate is particularly preferred for use in a housing disclosed herein. For a cellulose acetate propionate, the weight percent propionyl preferably is in a range of about 35 to about 55, more preferably about 40 to about 50, and the weight percent acetyl is preferably in a range of about 0.5 to about 10, more preferably about 1 to about 5. The average molecular weight of a cellulose acetate propionate used in a housing preferably is in a range of about 60,000 daltons to about 80,000 daltons.

A preferred clear, sharpenable cellulose ester is a blend of cellulose acetate propionate and plasticizer sold by Eastman Chemical Company under the trade name TENITE Propionate 384A4000016. This cellulose acetate propionate is believed to have a DS of propionyl of 46 wt. %, a DS of acetyl of 2.5 wt. %, and an average molecular weight of about 69,000 Daltons (a degree of polymerization of about 220).

Cellulose esters have beau found to be characterized by exceptional resistance to chemical attack (e.g., chemically-induced stress cracking), and advantageously resistant to attack by chemicals commonly used in cosmetic applications, such as alcohols; lipids including fats, oils, and waxes; aliphatic hydrocarbons; aqueous and anhydrous gels; detergents; and soaps. Accordingly, the marking material can be disposed in direct contact with the housing material.

The housing can also include one or more other additives to enhance performance or appearance of a marking instrument. Such additives include, but are not limited to, plasticizers, heat stabilizers, slip agents (e.g., lubricants for extrusion and mold release agents), odor masking agents, ultraviolet light barriers, pigments, dyes, waxes, nucleating agents (e.g., to improve rate of crystallization), and blowing agents, and combinations thereof. Blowing agents are particularly useful for use in extrusion fabrication methods, and are believed to aid in creating a cell structure that facilitates sharpenability in a pencil-type barrel housing.

The type and amount of a plasticizer can affect the mechanical properties of a housing and a marking instrument made therefrom. In particular a lower plasticizer content yields a harder surface, higher heat resistance, greater rigidity, higher tensile strength, and better dimensional stability. Higher plasticizer content increases impact strength. Inclusion of a plasticizer can also aid in processing a cellulose ester polymer. Plasticizers include nonvolatile organic liquids and low-melting solids (e.g., phthalate, adipate, azelate, citrate, and sebacate esters), polyols such as ethylene glycol and its derivatives, tricresyl phosphate, castor oil, TEXANOL isobutyrate (2,2,4-trimethyl-1,3-pentanediol diisobutyrate), and the like.

Aliphatic carboxylic esters, particularly dialkyl adipates (e.g., bis(2-ethylhexyl) adipate), azelates (e.g., dibutyl azelate), citrates (e.g., acetyl triethyl citrate), and ethylene glycol derivatives (e.g., triethylene glycol totanoate and triethylene glycol diheptanoate) are preferred.

Preferably, a plasticizer is included in an amount in a range of about 3 weight percent (wt. %) to about 35 wt. %, based on the total weight of the housing, preferably about 12 wt. % to about 20 wt. %, for example about 15 wt. % to about 17 wt. %.

In one embodiment, the housing includes a transparent or translucent region, or is completely translucent or transparent. The term "transparent" as used herein, unless otherwise specified, is intended to connote its usual dictionary definition. Thus, a transparent substance, like glass, allows ready viewing of objects behind the substance. A "translucent" substance allows light to pass through, but causes the light to be so scattered that it is impossible to clearly identify objects behind the translucent substance. For example, a composition is transparent if the maximum transmittance of light of any wavelength in the range about 200 nm to about 800 nm through a sample 10 cm thick is at least about 5%. A composition can be considered optically clear if the transmittance through a sample 1.52 mm (0.06 in.) thick is at least about 90%. Similarly, for example, a composition is translucent if such light through the sample is between about 0.01% and about 5%. The term "opaque" means that the maximum transmittance of such light is below about 0.01%. Transmittance can be easily measured by placing a sample of the composition having the required thickness in the light path of a UV-VIS Spectrophotometer such as the Hewlett-Packard 8451A Diode Ray Spectrophotometer. The advantage of this method of assessing transparency is that it is highly sensitive to optical clarity while independent of color.

A housing including a cellulose ester, such as the preferred types described herein, can be molded, extruded, and fabricated. Advantageously, a housing described herein can accept various types of secondary fabrication, including surface finishing (e.g., solvent polishing, vapor polishing, wheel polishing, and sanding), mechanical fabricating (e.g., drilling, milling, sad cutting), assembling (e.g., mechanical, solvent based cementing, by adhesives, by spin welding and ultrasonic welding), and decorating (e.g., by silk screen, metallization, metal coating, electroplating, lacquering, and painting).

Another aspect of the disclosure is a marking instrument that includes a pigmented marking mass disposed in a housing described above. Preferred types of instruments are generally stick-shaped for ease of production, storage, handling, and use. Thus, for example, the housing can include a generally cylindrical, hollow barrel (e.g., a tube) encasing a cosmetic mass. In one embodiment, the cosmetic mass includes an oil, and the cosmetic mass is in direct contact with the barrel. The barrel can be sealed at one or both ends prior to marking. Closures such as end caps and point protectors can be provided for either end.

The interior cross-section of the barrel can take any shape, including regular geometric shapes (e.g., circular, elliptical square, rectangle, and hexagonal), can be constant or varied throughout the length of the barrel, and can include a smooth or irregular surface. Thus, in one embodiment, hollow core of a barrel can have a generally tapered cross section made up of segmented rings, to substantially prevent a marking material from being displaced in one axial direction. In another embodiment, the core can have a constant cross-section, and the instrument can include a pin for mechanical displacement (e.g., push-up) of a marking mass.

The exterior cross-section of the barrel can also take any shape and can be constant or varied throughout the length of the barrel. Preferably, the exterior cross-section of the barrel is beveled at a tip end, for example in a range of about 10 degrees to 30 degrees with respect to the major axis of the instrument, such as 20 degrees.

For translucent and/or transparent housings, the wall thickness of a portion of the barrel intended for viewing is preferably in a range of about 1 mm to about 6 mm, preferably about 2 mm to about 4 mm, for example about 3.3 mm.

The sole FIGURE is a cross-sectional view of a embodiment of a marking instrument 10 according to the disclosure. The instrument 10 includes a generally cylindrical cosmetic mass 12 encased in a housing 14. The housing 14 includes a tapered tip section 16, and an end section 20 having a reduced exterior diameter for interface with an end cap (not shown). A tip section 22 of the cosmetic mass 12 is tapered to a point.

Another aspect of the disclosure is a method of making a housing and a marking instrument that includes a housing. A housing according to the disclosure can be made by any suitable process, including molding such as injection molding, extruding, and fabricating (e.g., by turning and drilling). Injection molding and extruding are preferred.

An injection-molded housing has virtually limitless design potential. A core pin can be used to provide a hollow core in a housing in any of a variety of shapes, including regular geometric shapes, segmented rings, flutes, undercuts, and the like. A molding operation can provide desired optional features such as tapered tips, end fittings (e.g., a shoulder or a sealed end) in a single molding operation, and thus eliminate downstream finishing operations otherwise necessary in extrusion and fabrication processes to provide the same features.

An extruded housing tube can also be provided with various cross-sectional shapes by varying the extruder die. An extruded housing can be filled with a marking mass during the extrusion process. In the alternative, an extruded housing can be divided to a desired length and subsequently filled.

A housing can be provided with one or more surface finishes (e.g., for decoration or to alter surface energy) including a surface provided by a bead-blasted mold piece, by solvent polishing, corona treatment, flame treatment, plasma treatment, and combinations thereof.

Housings can be decorated by various methods, including roll-on imprinting, silk screening, foil or pigment wraps, color matching/mismatching of a housing to a marking mass, any of the methods described above, and combinations thereof. Molded housings also can be decorated by in-mold print decoration.

EXAMPLES

The following examples are provided to illustrate the invention but are not intended to limit the scope of the invention.

Example 1

An optically clear, plasticized, cellulose acetate propionate polymer (TENITE Propionate 384A4000016) was injection molded at a temperature of about 360° F. to about 450° F. (about 182° C. to about 232° C.) and a pressure of about 700 psig to about 1200 psig (about 4800 kPa to about 8300 kPa) to provide cosmetic pencil barrels in the general shape shown in FIG. 1. The barrels had a circular cylindrical shape, with an outer diameter of 0.4 in. (10.16 mm) and an inner diameter of 0.27 in. (6.86 mm). The tip-end of the barrels was molded with a 20 degree taper (with respect to the major axis of the outer surface of the barrel). The barrels were about 3.57 in. (90.61 mm) long, end-to-end. The opposite end region of the barrels, adapted for engaging a cap, included an end region of reduced outer diameter (0.357 in., 9.0 mm) and 0.434 in. (11.02 mm) in length was provided opposite the tip end, with a raised shoulder commencing 0.112 in. (2.84 mm) from the primary shoulder formed by the decrease in outer diameter, and an 11° taper commencing 0.0625 in. (1.59 mm) from the end.

The barrels were each loaded from the cap end with a stick of anhydrous cosmetic mass used to color the skin of the eye or lip area. The cosmetic mass was solid at room temperature, and contained one or more of a wax, a gelled hydrocarbon (e.g., with VERSAGEL brand gelling agent, available from Penreco of Karns City, Pa.), and petrolatum. The barrels were sealed with a press-fit plastic or metallic cap. The color of the cosmetic mass inside the barrels could be easily identified through the barrels themselves from the outside. The pencils provided controllable dispensation of the cosmetic mass to human skin by writing and, as the cosmetic mass was depleted at the tip and, the barrels were sharpened in an ordinary cosmetic pencil sharpener to provide new tapered tips of cosmetic stick and tapered ends of barrel material. When not in use, the tip-ends of the cosmetic sticks were protected by providing a translucent or transparent, press-fit cap of plastic or metal material over the tip-end of the barrel, such as polypropylene, cellulosic plastics, or a terpolymer alloy sold under the trade name KOSTRATE EDGE MAX E terpolymer alloy by Plastic Selection Group, Inc. of Columbus, Ohio.

The foregoing description is given for clearness of understanding only, and no unnecessary limitations should be understood therefrom, as modifications within the scope of the invention may be apparent to those having ordinary skill in the art.

What is claimed is:

1. A marking instrument, comprising a pigmented marking mass comprising an oil encased in a housing in direct contact with said housing, said housing comprising cellulose acetate propionate and comprising a translucent or transparent region.

2. The instrument of claim 1, wherein said pigmented marking mass comprises a cosmetic mass.

3. The instrument of claim 1, wherein said housing is sharpenable.

4. The instrument of claim 1, wherein said housing comprises a mixed cellulose ester.

5. The instrument of claim 1, wherein the weight percent of propionyl is in a range of about 35 to about 55, and the weight percent of acetyl is in a range of about 0.5 to about 10.

6. The instrument of claim 5, wherein the weight percent of propionyl is in a range of about 40 to about 50, and the weight percent of acetyl is in a range of about 1 to about 5.

7. The instrument of claim 1, said housing having a degree of substitution of propionyl in said cellulose ester is in a range of about 1 to about 3.

8. The instrument of claim 1, wherein said housing comprises a transparent region.

9. The instrument of claim 8, wherein said transparent region has a wall thickness in a range of about 1 mm to about 6 mm.

10. The instrument of claim 1, wherein said housing further comprises a plasticizer.

11. The instrument of claim 10, wherein said plasticizer is present in an amount in a range of about 3 wt. % to about 35 wt. %, based on the total weight of the housing.

12. The instrument of claim 11, wherein said plasticizer is present in an amount in a range of about 12 wt. % to about 20 wt. %, based on the total weight of the housing.

13. The instrument of claim 12, wherein said plasticizer is present in an amount in a range of about 15 wt. % to about 17 wt. %, based on the total weight of the housing.

14. The instrument of claim 1, wherein said housing further comprises a material selected from the group consisting of heat stabilizers, slip agents, ultraviolet light barriers, pigments, dyes, waxes, nucleating agents, blowing agents, and combinations thereof.

15. The instrument of claim 1, wherein said housing comprises a translucent region.

16. A cosmetic pencil comprising a cosmetic mass encased in a sharpenable, translucent, pencil barrel comprising cellulose acetate propionate and about 14 wt. % to about 16 wt. % of a plasticizer.

17. In a cosmetic pencil comprising a cosmetic mass comprising an oil encased in and in direct contact with barrel, the improvement wherein said barrel comprises cellulose acetate propionate and said barrel is translucent or transparent.

18. A cosmetic pencil comprising a cosmetic mass encased in a sharpenable, transparent, pencil barrel comprising cellulose acetate propionate and about 14 wt. % to about 16 wt. % of a plasticizer.

* * * * *

UNITED STATES PATENT AND TRADEMARK OFFICE

CERTIFICATE OF CORRECTION

PATENT NO. : 6,935,800 B2
APPLICATION NO. : 10/267724
DATED : August 30, 2005
INVENTOR(S) : Marvin J. Hetzel It is certified that error appears in the above-identified patent and that said Letters Patent is hereby corrected as shown below:

In the Claims:

At Column 6, at line 47, “ester is in a range” should be --ester in a range--;

At Column 7, at line 10, “with barrel” should be --with a barrel--.

Signed and Sealed this

Twentieth Day of February, 2007

JON W. DUDAS
*Director of the United States Patent and Trademark Office*